US006797689B2

(12) United States Patent
Eyres et al.

(10) Patent No.: US 6,797,689 B2
(45) Date of Patent: Sep. 28, 2004

(54) METHOD OF REDUCING THE VISCOSITY OF FABRIC CONDITIONING COMPOSITIONS

(75) Inventors: David Robert Eyres, Wirral (GB); David Stephen Grainger, Wirral (GB); Andrew David Green, Wirral (GB); John Francis Hubbard, Wirral (GB); Mansur Sultan Mohammadi, Wirral (GB); Kevin Anthony Ormandy, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 106 days.

(21) Appl. No.: 10/237,398

(22) Filed: Sep. 9, 2002

(65) Prior Publication Data

US 2003/0114336 A1 Jun. 19, 2003

(30) Foreign Application Priority Data

Sep. 10, 2001 (GB) ..... 0121806

(51) Int. Cl.[7] ..... C11D 1/835
(52) U.S. Cl. ..... 510/521
(58) Field of Search ..... 510/515, 504, 510/522, 527, 521

(56) References Cited

U.S. PATENT DOCUMENTS

| | | | | |
|---|---|---|---|---|
| 3,644,203 A | | 2/1972 | Lamberti et al. | |
| 3,915,867 A | * | 10/1975 | Kang et al. | 510/525 |
| 4,213,867 A | | 7/1980 | Cukier et al. | |
| 4,386,000 A | | 5/1983 | Turner et al. | |
| 4,844,823 A | | 7/1989 | Jacques et al. | |
| 5,500,137 A | | 3/1996 | Bacon et al. | |
| 5,939,377 A | | 8/1999 | Ewbank et al. | |
| 6,004,913 A | * | 12/1999 | Iacobucci et al. | 510/123 |
| 6,486,121 B2 | * | 11/2002 | Wahl et al. | 510/527 |
| 6,620,777 B2 | * | 9/2003 | Heibel et al. | 510/516 |

FOREIGN PATENT DOCUMENTS

| | | | |
|---|---|---|---|
| DE | 25 03 026 A | | 7/1976 |
| DE | 31 50 179 A | | 6/1983 |
| DE | 44 02 527 A1 | | 8/1995 |
| EP | 0 409 502 A2 | | 1/1991 |
| EP | 0 409 504 A2 | | 1/1991 |
| EP | 0 415 698 A2 | | 3/1991 |
| EP | 730023 | * | 9/1996 |
| GB | 2 007 734 A | | 5/1979 |
| WO | 93/23510 | | 11/1993 |
| WO | 98/49132 | | 11/1998 |
| WO | 99/50378 | | 10/1999 |
| WO | 01/32813 A1 | | 5/2001 |
| WO | 01/46360 A1 | | 6/2001 |
| WO | 01/59200 A1 | | 8/2001 |
| WO | 02/20706 A1 | | 3/2002 |

OTHER PUBLICATIONS

Search Report under Section 17 (GB 0121806.4—dated Apr. 4, 2002).

"Quantitative $^{13}C$ NMR Spectroscopy with Inverse Gated$^{1}H$–Decoupling"; *Quantitative Determinations*; pp. 234–236.

International Search Report PCT/EP 02/09867, dated Jan. 16, 2003, 4 pp.

Derwent WPI Account No. 1995–269888/199536 abstract of DE 44 02 527 A1—1 page.

* cited by examiner

*Primary Examiner*—John R. Hardee
(74) *Attorney, Agent, or Firm*—Ellen Plotkin

(57) ABSTRACT

A method of thinning a fabric conditioning composition comprising (a) from 7.5 to 80% by weight of a ester-linked quaternary ammonium fabric softening material comprising at least one mono-ester linked component and at least one tri-ester linked component; comprises the step of adding a fatty complexing agent (b) to the composition in an amount such that the weight ratio of the mono-ester linked component of compound (a) to fatty complexing agent (b) is from 2.93:1 to 1:5.

4 Claims, No Drawings

METHOD OF REDUCING THE VISCOSITY OF FABRIC CONDITIONING COMPOSITIONS

FIELD OF THE INVENTION

The present invention relates to a method of reducing the viscosity of fabric conditioning compositions.

BACKGROUND OF THE INVENTION

It is well known to provide liquid fabric conditioning compositions which soften in the rinse cycle.

Such compositions comprise less than 7.5% by weight of softening active, in which case the composition is defined as "dilute", from 7.5% to about 30% by weight of active in which case the compositions are defined as "concentrated" or more than about 30% by weight of active, in which case the composition is defined as "super-concentrated".

Concentrated and super-concentrated compositions are desirable since these require less packaging and are therefore environmentally more compatible than dilute or semi-dilute compositions.

A problem frequently associated with concentrated and superconcentrated compositions, as defined above, is that the product is not stable, especially when stored at high temperatures. Instability can manifest itself as a thickening of the product upon storage, even to the point that the product is no longer pourable.

The problem of thickening upon storage is particularly apparent in concentrated and superconcentrated fabric softening compositions comprising an ester-linked quaternary ammonium fabric softening material having one or more fully saturated alkyl chains.

A further problem known to affect concentrated and super-concentrated fabric softening compositions comprising an ester-linked quaternary ammonium fabric softening material having one or more fully saturated alkyl chains is that the initial viscosity of a fully formulated composition can be very high, up to a point that the composition is substantially unpourable.

However, it is desirable to use ester-linked compounds due to their inherent biodegradability and to use substantially fully saturated quaternary ammonium fabric softening compounds due to their excellent softening capabilities and because they are more stable to oxidative degradation (which can lead to malodour generation) than partially saturated or fully unsaturated quaternary ammonium softening compounds.

Of the types of ester-linked quaternary ammonium materials known, it is desirable to use those based on triethanolamine which produce at least some mono-ester linked component and at least some tri-ester linked component since the raw material has a low melting temperature which enables the manufacturing process of the composition to occur at low temperatures. This reduces difficulties associated with high temperature handling, transport and processing of the raw material and compositions produced therefrom.

The problem of high initial viscosity and visco-stability upon storage has previously been addressed in various ways.

For instance, EP-A2-0415698 (Unilever) discloses the use of electrolytes, polyelectrolytes, or decoupling polymers to reduce the viscosity of fabric softening compositions.

It is also known that an input of energy such as milling or shearing of the product can reduce product viscosity.

However, compositions produced by this approach can suffer from colloidal instability. Also, milling or shearing products in an manufacturing process on an industrial scale is time consuming and expensive.

DE 2503026 (Hoechst) discloses formulations comprising 3–12% of a softener (a mixture of non-ester quaternary ammonium compounds imidazoline group containing compounds), 1–6% of a cationic disinfectant, 0.1–5% of a lower alcohol, 0.5–5% of a fatty alcohol and 0–5% of a nonionic emulsifier.

WO 99/50378 (Unilever) relates to compositions comprising from 1 to 8% of a quaternary ammonium compound, a stabilising agent and a fatty alcohol. The fatty alcohol is present in order to thicken the dilute composition. The disclosure only relates to dilute compositions and so is not in any way directed to the problem addressed in the present invention of high temperature storage stability of concentrated compositions.

U.S. Pat. No. 4,844,823 (Colgate-Palmolive) discloses a composition comprising 3 to 20% by weight of the combination of a mixture of quaternary ammonium fabric softening compound and fatty alcohol in a weight in a weight ratio 6:1 to 2.8:1. Only non-ester quaternary ammonium compounds are exemplified and there is no disclosure or teaching of fully saturated quaternary ammonium compounds.

The prior art does not address nor given any suggestion how to overcome high initial viscosity and/or high temperature storage stability problems in concentrated compositions comprising fully hardened quaternary ammonium ester linked compounds based on triethanolamine.

WO 93/23510 (Procter & Gamble) mentions fatty alcohols and fatty acids as optional nonionic softeners and teaches that they can improve the fluidity of premix melts. There is no reference to reducing the viscosity of dispersions made from premix melts.

WO 98/49132, U.S. Pat. Nos. 4,213,867, 4,386,000, GB-A-2007734, DE 2503026, DE 3150179, U.S. Pat. Nos. 5,939,377, 93,915,867 and 3,644,203 all disclose fabric conditioning compositions comprising fatty alcohols. Fatty alcohols are known as co-softeners and for increasing the viscosity of compositions.

None of the prior art teaches that fatty alcohols can be used to prevent an increase in the viscosity of concentrated fabric conditioning compositions and/or to overcome the problem of high initial viscosity of the fully formulated composition.

OBJECTS OF THE INVENTION

The present invention seeks to address one or more of the above-mentioned problems, and, to give one or more of the above-mentioned benefits desired by consumers.

It has surprisingly been found that by incorporating a fatty component which comprises a long alkyl chain, such as a fatty alcohol or fatty acid (hereinafter referred to as "fatty completing agent") into softening compositions comprising a quaternary ammonium softening material having substantially fully saturated alkyl chains, at least some mono-ester linked component and at least some tri-ester linked component, where the fatty complexing agent is present in an amount significantly greater than normally present in traditional fabric softening compositions, then the stability and initial viscosity of the composition can be dramatically improved. In particular, undesirable thickening of the composition upon storage can be avoided.

SUMMARY OF THE INVENTION

According to the present invention there is provided:

a method of thinning a fabric conditioning composition comprising (a) from 7.5 to 80% by weight of a ester-linked quaternary ammonium fabric softening material comprising at least one mono-ester linked component and at least one tri-ester linked component; the method comprising the step of adding a fatty complexing agent (b) to the composition in an amount such that the weight ratio of the mono-ester linked component of compound (a) to fatty complexing agent (b) is from 2.93:1 to 1:5.

There is further provided a method of treating fabrics comprising contacting a fabric conditioning composition prepared according to the method of the invention with fabrics in a laundry treatment process.

In the context of the present invention, the term "comprising" means "including" or "consisting of". That is the steps, components, ingredients, or features to which the term "comprising" refers are not exhaustive.

DETAILED DESCRIPTION OF THE INVENTION

The compositions of the present invention are preferably rinse conditioner compositions, more preferably aqueous rinse conditioner compositions for use in the rinse cycle of a domestic laundry process.

Quaternary Ammonium Fabric Softening Material

The fabric conditioning material used in the compositions of the present invention comprises one or more quaternary ammonium materials comprising a mixture of mono-ester linked, di-ester linked and tri-ester linked compounds.

By mono-, di- and tri-ester linked components, it is meant that the quaternary ammonium softening material comprises, respectively, a quaternary ammonium compound comprising a single ester-link with a fatty hydrocarbyl chain attached thereto, a quaternary ammonium compound comprising two ester-links each of which has a fatty hydrocarbyl chain attached thereto, and a quaternary ammonium compound comprising three ester-links each of which has a fatty hydrocarbyl chain attached thereto.

Below is shown typical levels of mono-, di- and tri-ester linked components in a fabric softening material used in the compositions of the invention.

| Component | % by weight of the raw material (TEA based softener with solvent) |
|---|---|
| Mono-ester | 10–30 |
| Di-ester | 30–60 |
| Tri-ester | 10–30 |
| Free fatty acid | 0.2–1.0 |
| Solvent | 10–20 |

The level of the mono-ester linked component of the quaternary ammonium material used in the compositions of the invention is preferably between 8 and 40% by weight, based on the total weight of the raw material in which the quaternary ammonium material is supplied.

The level of the tri-ester linked component is preferably between 20 and 50% based on the total weight of the raw material in which the quaternary ammonium material is supplied.

The level of the tri-ester-linked component is preferably between 20 and 50% by weight, based on the total weight of quaternary ammonium material.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The preferred ester-linked quaternary ammonium cationic softening material for use in the invention is represented by formula (I):

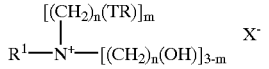

(I)

wherein each R is independently selected from a $C_{5-35}$ alkyl or alkenyl group, $R^1$ represents a $C_{1-4}$ alkyl or hydroxyalkyl group or a $C_{2-4}$ alkenyl group, T is

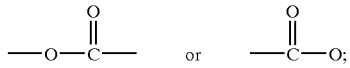

n is O or an integer selected from 1 to 4, m is 1, 2 or 3 and denotes the number of moieties to which it refers that pend directly from the N atom, and $X^-$ is an anionic group, such as halides or alkyl sulphates, e.g. chloride, methyl sulphate or ethyl sulphate.

Especially preferred materials within this class are di-alkyl and di-alkenyl esters of triethanol ammonium methyl sulphate. Commercial examples of compounds within this formula are Tetranyl® AHT-1 (di-hardened tallowyl ester of triethanol ammonium methyl sulphate 85% active), L1/90 (partially hardened tallow ester of triethanol ammonium methyl sulphate 90% active), and L5/90 (palm ester of triethanol ammonium methyl sulphate 90% active), all ex Kao corporation), Rewoquat WE18 and WE20 (both are partially hardened tallow ester of triethanol ammonium methyl sulphate 90% active), both ex Goldschmidt Corporation and Stepantex VK-90 (partially hardened tallow ester of triethanol ammonium methyl sulphate 90% active) ex Stepan Company).

Iodine Value of the Parent Fatty Acyl Group or Acid

The iodine value of the parent fatty acyl compound or acid from which the quaternary ammonium fabric softening material is formed is from 0 to 20, preferably from 0 to 5, more preferably from 0 to 2. Most preferably the iodine value of the parent fatty acid or acyl group from which the quaternary ammonium fabric softening material is formed is from 0 to 1. That is, it is preferred that the alkyl or alkenyl chains are substantially fully saturated.

If there is any unsaturated quaternary ammonium fabric softening material present in the composition, the iodine value, referred to above, represents the mean iodine value of the parent fatty acyl compounds or fatty acids of all of the quaternary ammonium materials present.

In the context of the present invention, iodine value of the parent fatty acyl compound or acid from which the fabric softening material formed, is defined as the number of grams of iodine which react with 100 grams of the compound.

In the context of the present invention, the method for calculating the iodine value of a parent fatty acyl compound/acid comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150-ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

The quaternary ammonium fabric softening material of formula (I) is present in an amount from about 7.5 to 80% by weight of quaternary ammonium material (active ingredient) based on the total weight of the composition, more preferably 10 to 60% by weight, most preferably 11 to 40% by weight, e.g. 12.5–25% by weight.

Excluded Quaternary Ammonium Compounds

Quaternary ammonium fabric softening materials which are free of ester linkages or, if ester-linked, do not comprise at least some mono-ester component and some tri-ester component are excluded from the scope of the present invention. For instance, quaternary ammonium compounds having the following formulae are excluded:

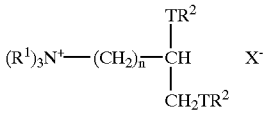

wherein $R^1$, $R^2$, T, n and $X^-$ are as defined above; and

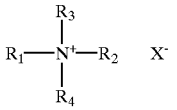

where $R_1$ to $R_4$ are not interrupted by ester-links, $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Fatty Complexing Agent

The compositions of the present invention comprise a fatty complexing agent.

Especially suitable fatty complexing agents include fatty alcohols and fatty acids. Of these, fatty alcohols are most preferred.

Without being bound by theory, it is believed that higher levels of the mono-ester linked component lowers the viscosity of the product. In other words, it is expected that, for a given level of the mono-ester linked component, the addition of a fatty complexing agent would increase the viscosity for two reasons, namely because additional active material is added thereby increasing phase volume, and because fatty alcohol can alter the electrostatic interactions of the particles. It increases the charge on the bilayers and this translates into a larger phase volume, hence a larger viscosity.

However, the applicants have found in the present invention that the addition of higher levels of the fatty complexing agent reduces the viscosity.

It is not fully understood why this effect occurs but it is believed that a significant factor contributing to the improved viscosity profile of the composition is the complexation of the fatty complexing material with the mono-ester linked component of the fabric softening material thereby providing a composition which has relatively higher levels of di-ester and tri-ester linked components.

Since this effect is most significant in compositions comprising quaternary ammonium materials which comprise a mixture of mono-, di- and tri-ester linked components, compositions which do not comprise both mono-ester linked and tri-ester linked components do not fall within the scope of the invention.

It is also believed that the higher levels of mono-ester linked component present in compositions comprising quaternary ammonium materials based on TEA may destabilise the composition through depletion flocculation. By using the fatty complexing material to complex with the mono-ester-linked component, depletion flocculation is significantly reduced.

In other words, the fatty complexing agent at the increased levels, as required by the present invention, "neutralises" the mono-ester linked component of the quaternary ammonium material.

The applicants also believe that that complexing of the mono-ester linked component (which does not contribute to softening) with the fatty complexing material thereby provides a material which does contribute to softening.

Preferred fatty acids include hardened tallow fatty acid (available under the tradename Pristerene, ex Uniqema).

Preferred fatty alcohols include hardened tallow alcohol (available under the tradenames Stenol and Hydrenol, ex Cognis and Laurex CS, ex Albright and Wilson) and behenyl alcohol, a C22 chain alcohol, available as Lanette 22 (ex Henkel).

The fatty complexing agent is present in an amount greater than 0.5% to 15% by weight based on the total weight of the composition. More preferably, the fatty component is present in an amount of from 0.75 to 10%, most preferably from 1.0 to 5%, e.g. 1.25 to 4% by weight.

The weight ratio of the mono-ester component of the quaternary ammonium fabric softening material to the fatty complexing agent is from 2.93:1 to 1:5, more preferably 2.8:1 to 1:4, most preferably 2.5:1 to 1:3, e.g. 2:1 to 1:2.

Calculation of Mono-ester Linked Component of the Quaternary Ammonium Material

The quantitative analysis of mono-ester linked component of the quaternary ammonium material is carried out through the use of Quantitative $^{13}C$ NMR spectroscopy with inverse gated $^1H$ decoupling scheme.

The sample of known mass of the quaternary ammonium raw material is first dissolved in a known volume of $CDCl_3$ along with a known amount of an assay material such as naphthalene. A $^{13}C$ NMR spectrum of this solution is then recorded using both an inverse gated decoupling scheme and a relaxation agent. The inverse gated decoupling scheme is used to ensure that any Overhauser effects are suppressed whilst the relaxation agent is used to ensure that the negative consequences of the long $t_1$ relaxation times are overcome (i.e. adequate signal-to-noise can be achieved in a reasonable timescale).

The signal intensities of characteristic peaks of both the carbon atoms in the quaternary ammonium material and the naphthalene are used to calculate the concentration of the mono-ester linked component of the quaternary ammonium material. In the quaternary ammonium material, the signal represents the carbon of the nitrogen-methyl group on the quaternary ammonium head group. The chemical shift of the nitrogen-methyl group varies slightly due to the different degree of esterification; characteristic chemical shifts for the mono-, di- and tri-ester links are 48.28, 47.97 and 47.76 ppm respectively. Any of the peaks due to the napthalene carbons that are free of interference from other components can then be used to calculate the mass of mono-ester linked component present in the sample as follows:—

$$\text{Mass}_{MQ}(\text{mg/ml})=(\text{mass}_{Naph}\times I_{MQ}\times N_{Naph}\times M_{MQ})/(I_{Naph}\times N_{MQ}\times M_{Naph})$$

where $\text{Mass}_{MQ}$=mass mono-ester linked quaternary ammonium material in mg/ml, $\text{mass}_{Naph}$=mass naphthalene in mg/ml, I=peak intensity, N=number of contributing nuclei and M=relative molecular mass. The relative molecular mass of naphthalene used is 128.17 and the relative molecular mass of the mono-ester-linked component of the quaternary ammonium material is taken as 526.

The weight percentage of mono-ester linked quaternary ammonium material in the raw material can thus be calculated:

% of mono-ester linked quaternary ammonium material in the raw material=$(\text{mass}_{MQ}/\text{mass}_{HT\text{-}TEA})\times 100$ where mass $_{HT\text{-}TEA}$=mass of the quaternary ammonium material and both mass $_{MQ}$ and mass $_{HT\text{-}TEA}$ are expressed as mg/ml.

For a discussion of the NMR technique, see "100 and More Basic NMR Experiments", S Braun, H-O Kalinowski, S Berger, 1st edition, pages 234–236.

Nonionic Surfactant

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water-soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

—O—, —C(O)O—, —C(O)N(R)— or —C(O)N(R)R— in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO (10); and $C_{18}$ EO (11). The ethoxylates of mixed natural or synthetic alcohols in the "tallow" chain length range are also useful herein. Specific examples of such materials include tallow alcohol-EO (11), tallow alcohol-EO (18), and tallow alcohol-EO (25), coco alcohol-EO (10), coco alcohol-EO (15), coco alcohol-EO (20) and coco alcohol-EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO (11); $C_{20}$ EO (11); and $C_{16}$ EO (14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO (11) and p-pentadecylphenol EO (18).

As used herein and as generally recognised in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols, which are available from the well-known "OXO" process, can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface-active agents.

The nonionic surfactant is preferably present in an amount from 0.01 to 10%, more preferably 0.1 to 5%, most preferably 0.35 to 3.5%, e.g. 0.5 to 2% by weight, based on the total weight of the composition.

Perfume

The compositions of the invention preferably comprise one or more perfumes.

The hydrophobicity of the perfume and oily perfume carrier are measured by ClogP. ClogP is calculated using the "ClogP" program (calculation of hydrophobicities as logp (oil/water)) version 4.01, available from Daylight Chemical Information Systems Inc of Irvine Calif., USA.

It is well known that perfume is provided as a mixture of various components.

It is preferred that at least a quarter (by weight) or more, preferably a half or more of the perfume components have a ClogP of 2.0 or more, more preferably 3.0 or more, most preferably 4.5 or more, e.g. 10 or more.

Suitable perfumes having a ClogP of 3 or more are disclosed in U.S. Pat. No. 5,500,137.

The perfume is preferably present in an amount from 0.01 to 10% by weight, more preferably 0.05 to 5% by weight, most preferably 0.5 to 4.0% by weight, based on the total weight of the composition.

Liquid Carrier

The liquid carrier employed in the instant compositions is preferably water due to its low cost relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Co-active Softeners

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate. If GMS is present, then it is preferred that the level of GMS in the composition, is from 0.01 to 10 wt %, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

Polymeric Viscosity Control Agents

It is useful, though not essential, if the compositions comprise one or more polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

Further Optional Ingredients

Other optional nonionic softeners, bactericides, soil-releases agents may also be incorporated in the compositions of the invention.

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, antioxidants, sunscreens, anti-corrosion agents, drape imparting agents, anti-static agents, ironing aids and dyes.

Product Form

In its undiluted state at ambient temperature the product comprises an aqueous liquid.

The compositions are preferably aqueous dispersions of the quaternary ammonium softening material.

Product Use

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Preparation

The compositions of the invention may be prepared according to any suitable method.

In a first preferred method, the quaternary ammonium material, fatty complexing agent, and optionally the non-ionic stabilising agent and perfume are heated together until a co-melt is formed. Water is then heated and the co-melt is added to water with stirring. Alternatively, the perfume can be added hot after the active ingredients have been added or can be added at different stages of cooling after active addition.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Example 1

Samples A to C, 1 and 2 were prepared at 200-ml scale. The fatty complexing agent and the ester-linked quaternary ammonium compound were heated together to between 50 and 60° C. and stirred in order to provide a co-melt. The co-melt was then slowly added to water also at the same temperature while agitating. After 10 minutes of mixing, the batch was cooled using recirculating cold water. No shearing or milling was used during the process.

TABLE 1

| Component (% by weight) | Sample A | Sample B | Sample 1 | Sample 2 | Sample 3 |
|---|---|---|---|---|---|
| Tetranyl AHT-1[a] | 13.0 | 13.0 | 13.0 | 13.0 | 13.0 |
| Fatty complexing agent[b] | 0 | 0.25 | 0.75 | 1.25 | 2.00 |
| Water | To 100 | To 100 | To 100 | To 100 | To 100 |
| Total active material (% by weight) | 13 | 13.25 | 13.75 | 14.25 | 15 |

TABLE 1-continued

| Component (% by weight) | Sample A | Sample B | Sample 1 | Sample 2 | Sample 3 |
|---|---|---|---|---|---|
| Weight Ratio of mono-ester component to fatty complexing agent | — | 8.84:1 | 2.93:1 | 1.76:1 | 1.10:1 |

[a]di-hardened tallowyl ester of triethanol ammonium methyl sulphate (available as 85% active softening material in 15% IPA, ex Kao)
[b]Tallow alcohol (available as Laurex CS, ex Albright and Wilson)

Table 2 shows the particle size and viscosity data for the samples prepared above.

TABLE 2

| Sample | A | B | 1 | 2 | 3 |
|---|---|---|---|---|---|
| Initial viscosity (mPas)[c] | 530 | 574 | 447 | 310 | 320 |
| Particle size[d] D[4,3] ($\mu$m) | 4.42 | 4.69 | 7.14 | 6.69 | 3.47 |

[c]measured at 106 $s^{-1}$ at 25° C. using a RV20 Haake Rotoviscometer and NV cup and bob.
[d]measured using a Malvern Mastersizer.

Since no intense shear or milling device was used in the preparation of these examples, the viscosity decreases at higher levels of fatty alcohol are directly attributable to the fatty alcohol level within the compositions.

The D[4,3] particle size results in this table demonstrate that, at first when low levels of fatty complexing agent are added, viscosity of the composition increases (A to B). When additional fatty complexing agent is added, the viscosity decreases (B to 1). This is particularly surprising since fatty alcohols are known as thickeners for fabric conditioning compositions (as exhibited by results A to B), and thus it would be expected that the addition of further fatty complexing agent would lead to further rises in viscosity.

As the weight ratio of the mono-ester linked component of the quaternary ammonium material to the fatty complexing agent is reduced below 2.93:1 and approaches 1:1 (samples 1 to 3), the viscosity is further reduced.

Example 2

Evaluation of the Fatty Complexing Agent on the Level of Mono-ester and Tri-ester Components For samples A to B, and 1 to 3, the change in the DSC peak position and maximum peak height (mW) as a function of fatty alcohol concentration were measured.

The peak position and its intensity was measured using a Perkin Elmer DSC-7 having a heating/cooling cycle of from 0 to 85° C. at 100° C. per minute with the transitions being measured on the $2^{nd}$ heating cycle.

The results are given in table 3.

TABLE 3

| Sample | Peak 1 (° C.) | Amplitude (mW) | Peak 2 (° C.) | Amplitude (mW) |
|---|---|---|---|---|
| Sample A | 47 | 4.044 | 57 | 3.021 |
| Sample B | 47 | 3.406 | 57 | 3.150 |
| Sample 1 | 46 | 2.439 | 59 | 3.400 |
| Sample 2 | 45 | 1.747 | 63 | 4.409 |
| Sample 3 | 45 | 1.050 | 65 | 5.636 |

The amplitude of peak 1 indicates the amount of mono-ester component present in the composition. The amplitude of peak 2 indicates the amount of tri-ester linked component (associated with some di-ester) present in the composition.

The results in table 3 demonstrate that by providing a fatty complexing agent in the compositions of the invention, the amplitude of peak 1 (the mono-ester rich phase of the softening compound) is dramatically reduced suggesting that the fatty complexing agent neutralises the mono-ester component.

What is claimed is:

1. A method of thinning a fabric conditioning composition comprising about 7.5% to about 80% by weight of an ester-linked quaternary ammonium fabric softening material comprising at least one mono-ester linked component and at least one tri-ester linked component;

wherein the weight ratio of the mono-ester linked component of the quaternary ammonium compound to fatty complexing agent is from 2:1 to 1:3;

said method comprising a step of adding a fatty complexing agent (b) to the composition in an amount such that the weight ratio of the mono-ester linked component of compound (a) to fatty complexing agent (b) is from 2.93:1 to 1:5;

wherein the fatty complexing agent is tallow alcohol.

2. A method as claimed in claim 1 wherein the quaternary ammonium material is represented by formula (I):

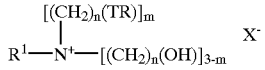

(I)

wherein each R is independently selected from a $C_{5-35}$ alkyl or alkenyl group, $R^1$ represents a $C_{1-4}$ alkyl or hydroxyalkyl group or a $C_{2-4}$ alkenyl group, T is

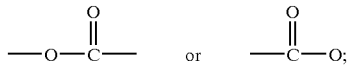

n is 0 or an integer selected from 1 to 4, m is 1, 2 or 3 and denotes the number of moieties to which it refers that pend directly from the N atom, and $X^-$ is an anionic group, such as halides or alkyl sulphates, e.g. chloride, methyl sulphate or ethyl sulphate.

3. A method as claimed claim 1, wherein the composition further comprises an oily sugar derivative.

4. A method of treating fabrics comprising contacting a fabric conditioning composition prepared according to the method as claimed in claim 1 with fabrics in a laundry treatment process.

* * * * *